United States Patent [19]

Jacobson et al.

[11] 4,159,877

[45] Jul. 3, 1979

[54] MATERIALS HANDLING AND APPLICATION MECHANISM

[75] Inventors: Carl C. Jacobson, Tempe; Mark C. Manning, Gilbert; Francis K. Hill, Wickenburg, all of Ariz.

[73] Assignee: Crafco, Inc., Phoenix, Ariz.

[21] Appl. No.: 894,892

[22] Filed: Apr. 10, 1978

[51] Int. Cl.[2] ..... B28C 1/22

[52] U.S. Cl. ..... 366/22; 366/13; 366/24; 366/138; 366/146; 366/149

[58] Field of Search ..... 366/22, 23, 24, 10, 366/11, 12, 13, 138, 146, 149

[56] References Cited

U.S. PATENT DOCUMENTS

| | | | |
|---|---|---|---|
| 2,565,826 | 8/1951 | Smith | 366/24 |
| 3,248,093 | 4/1966 | Demaison | 366/13 |
| 3,369,596 | 2/1968 | Maeland | 366/146 X |
| 3,610,588 | 10/1971 | Diefenbach | 366/24 |

*Primary Examiner*—Stanley N. Gilreath
*Attorney, Agent, or Firm*—Herbert E. Haynes, Jr.

[57] ABSTRACT

A self-contained mechanism for the preparation handling and application of liquified materials such as coating compounds, joint sealers, crack fillers, waterproofing compounds and the like, is provided with an especially configured materials tank having primary and secondary materials heating devices and a unique engine driven hydraulic system which allows reversible and variable speed operation of the materials mixing, delivery, and cleanout devices and systems.

18 Claims, 5 Drawing Figures

MATERIALS HANDLING AND APPLICATION MECHANISM

BACKGROUND OF THE INVENTION

1. Field of the Invention

This invention relates to mechanisms for the handling and application of materials, and more particularly to a mechanism for the preparation, handling, and application of liquified materials such as coating compounds, joint sealers, crack fillers, waterproofing compounds and other materials commonly used in the construction arts.

2. Description of the Prior Art

For many years, especially designed machines have been used for preparing, handling and applying the various liquified compounds used by the construction industry for filling, sealing, coating and related purposes. A specific type of such machine, hereinafter referred to as an asphalt machine, is employed for the preparation, handling and application of an asphalt-rubber composition used for jobs such as surfacing paved surfaces, filling and sealing cracks and joints in roadways, runways and other paved surfaces, repairing and coating roofing, and the like.

These so-called asphalt machines all include the same basic components of a materials tank which is provided with a suitable heating means to change the asphalt-rubber composition from its normally solid state to its molten state and maintain that molten state. An externally driven mixing mechanism is mounted in the materials tank to mix and maintain the granulated rubber and hot asphalt in a homogeneous state, and a pump is coupled to the outlet of the materials tank to deliver the molten asphalt-rubber composition to a suitable application device.

Several problems exist in the prior art asphalt machines partly due to the inherent characteristics of the asphalt-rubber composition itself, and partly due to the design of these prior art machines. It is well known that molten asphalt-rubber is a relatively heavy or thick, messy liquid which contaminates everything it comes in contact with. Thus, machines for handling and applying this material must be heavy duty, must be capable of maintaining the molten state of the material, and must be provided with a cleanout system.

With regard to the drive means provided on the prior art asphalt machines for pumping and mixing the molten asphalt-rubber composition, traditionally, the drive means includes an engine which is mechanically coupled to the mixer and pump by means such as a chain drive, clutch devices and/or the like. Such mechanical coupling results in frequent engine stalling particularly when the mixing mechanism is subjected to inconsistent loads when the asphalt-rubber composition is being melted, and also when the flow of the molten material being pumped is interrupted by the operator shutting down the applicator device and causing a sudden increase in line pressure and resultant loading of the materials pump. The frequent engine stalling is not only time consuming and inconvenient to the machine's operator, but it also subjects the machine's components to stresses which shorten the life of the machine.

The heating means provided on the prior art asphalt machines usually take the form of propane heaters which are continuously operated when materials are in the tank to prevent solidification thereof. No provisions are made for standby heating devices which would utilize an alternate more readily available energy form, and would reduce energy consumption during periods when the machine is not being used such as overnight, or when material application is delayed for other reasons. Thus, when such delays occur the heaters of the prior art asphalt machines must either be continuously operated, or otherwise considerable time must be expended to re-melt the asphalt-rubber compound.

Due to the relatively rapid solidification of the molten asphalt-rubber composition, means must be provided on the handling and application machines for pre-heating the applicator hoses and heating of the other lines through which the molten materials flow. Some of the prior art asphalt machines provide preheating storage compartments for the applicator hoses, however, to the best of our knowledge, none heat the materials flow line between the materials pump and the applicator hose and reduce the severity of solidification by keeping such lines as short as possible.

With regard to cleanout systems for purging of the materials pump and materials flow lines and hoses, the prior art machines usually carry tanks of solvent which is pumped through the various components to remove materials therefrom. Some of the prior art asphalt machines accomplish this cleanout function better than others, however, none to our knowledge, provide reversible flow of the solvent within the components.

Therefore, a new and improved materials handling and application mechanism is needed to overcome some of the problems and shortcomings of the prior art.

SUMMARY OF THE INVENTION

In accordance with the present invention, a new and improved materials handling and application mechanism is disclosed as including the basic components of a materials tank, means for heating and means for mixing the materials, a materials delivery system and a cleanout system.

The materials tank of the mechanism of the present invention is of special configuration to facilitate melting and/or maintaining the molten state of the materials contained in the tank. The tank is provided with a primary heating device for use during melting and materials dispensing operations, and a secondary or auxiliary heating device which utilizes a readily available energy source for maintaining the molten state of materials at a reduced rate of energy consumption during periods when the machine is in standby status. A unique engine driven hydraulic system is provided to power the mixing means and the materials delivery and cleanout system. The hydraulic system is provided with several special features which enhances operation of the machine of the present invention. One such feature is the incorporation of flow control valves in the system to provide the capability of independent variable speed operation of the materials pump and the mixer means. Switching valves are also provided for independent reversible driving of the materials pump and the mixer means. The inherent characteristics of a hydraulic system will prevent engine stalling which heretofore resulted from mechanical coupling of the engine with the various equipment which is driven thereby. The materials delivery system is provided with an automatic bypass device so that molten materials will be circulated rather than left standing in the materials flow lines when the machine operator shuts down the materials application device.

In addition to the above, the machine of the present invention includes other desirable features, such as heating of the materials flow lines and hoses to reduce the occurrence of material solidification therein. A single tank is provided with two separate comparments, one for containing hydraulic fluid and the other for the solvent that is used in the machine's cleanout system. This single tank configuration results in economic space utilization, allows optimum positioning thereof to hold flow line lengths to a minimum.

The materials handling and application mechanism of the present invention is specifically designed to handle asphalt-rubber compositions, however, the machine may be employed to handle virtually any liquid material such as those commonly used by the construction industry for filling, sealing, coating and similar purposes.

Accordingly, it is an object of the present invention to provide a new and improved materials handling and application mechanism.

Another object of the present invention is to provide a new and improved mechanism for preparation, handling, and application of the various liquified compounds used in the construction industry for filling, sealing, coating, and similar purposes.

Another object of the present invention is to provide a new and improved mechanism for preparation, handling, and application of liquified materials, with the mechanism being powered by an engine driven hydraulic system which eliminates, or at least substantially reduces, engine stalling, allows independent variable speed operation of the mechanism's materials delivery and mixing devices, and allows independent reversible driving of those same devices.

Another object of the present invention is to provide a new and improved mechanism of the above described character which is equipped with a primary heating device for melting and maintaining the molten state of the materials during machine operation, and is provided with a secondary heating device which utilizes a readily available energy form and maintains the molten state of the material at a reduced rate of energy consumption during standby status of the machine.

Another object of the present invention is to provide a new and improved mechanism of the above described type which includes a novel tank configuration for storage of hydraulic oil and cleanout solvent in a single two compartment tank to provide efficient space utilization, optimum positioning and minimym flow line lengths.

Still another object of the present invention is to provide a new and improved mechanism of the above described character which includes an especially configured materials tank that facilitates melting and maintenance of the molten state of the melted materials.

Yet another object of the present invention is to provide a new and improved mechanism of the above described character which includes means for heating the applicator hose and fluid flow lines to reduce the occurrence of materials solidification therein.

The foregoing and other objects of the present invention, as well as the invention itself may be more fully understood from the following description when read in conjunction with the accompanying drawings.

DESCRIPTION OF THE PREFERRED EMBODIMENT

Figure 1:
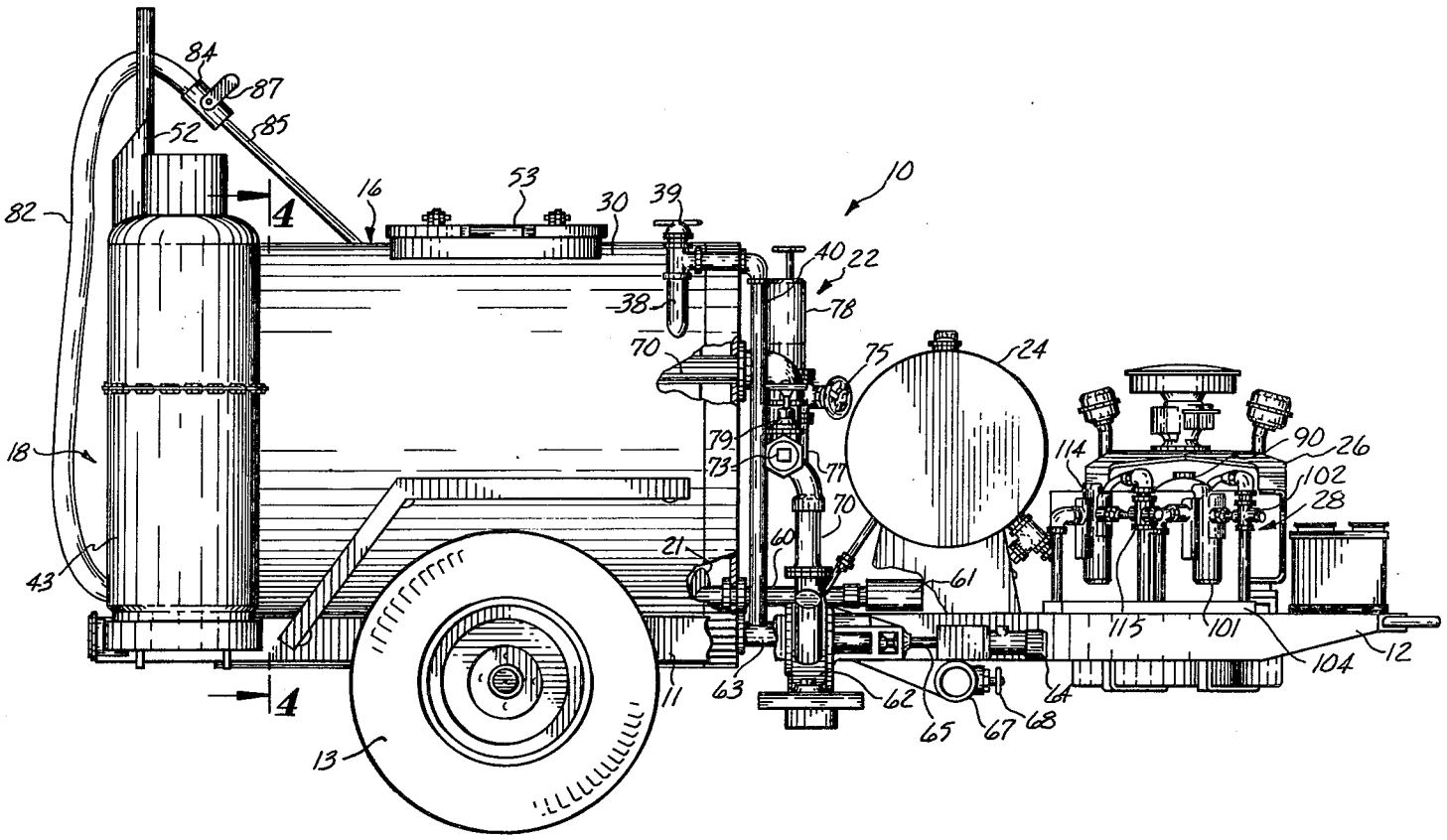
FIG. 1 is a side elevational view of the materials handling and application mechanism of the present invention with portions thereof broken away to illustrate the various features thereof.
Figure 2:
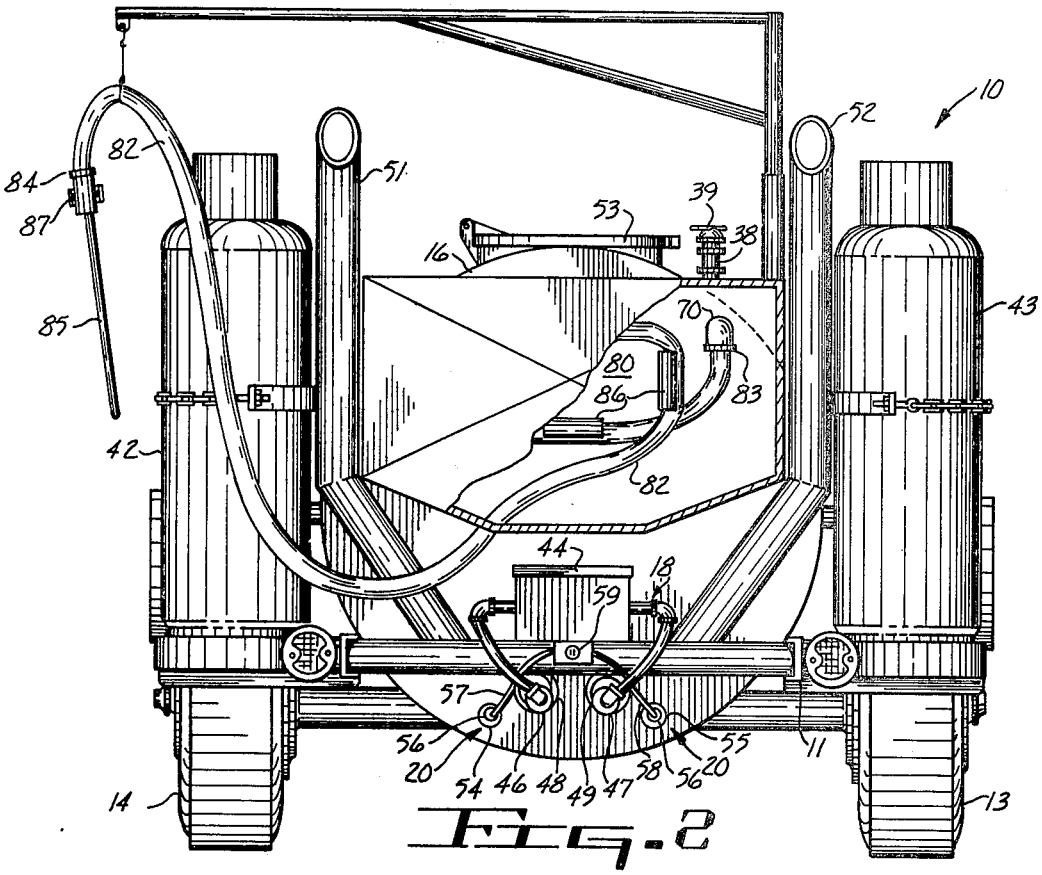
FIG. 2 is a rear elevational view of the mechanism of the present invention with portions thereof broken away to illustrate the various features thereof.
Figure 3:
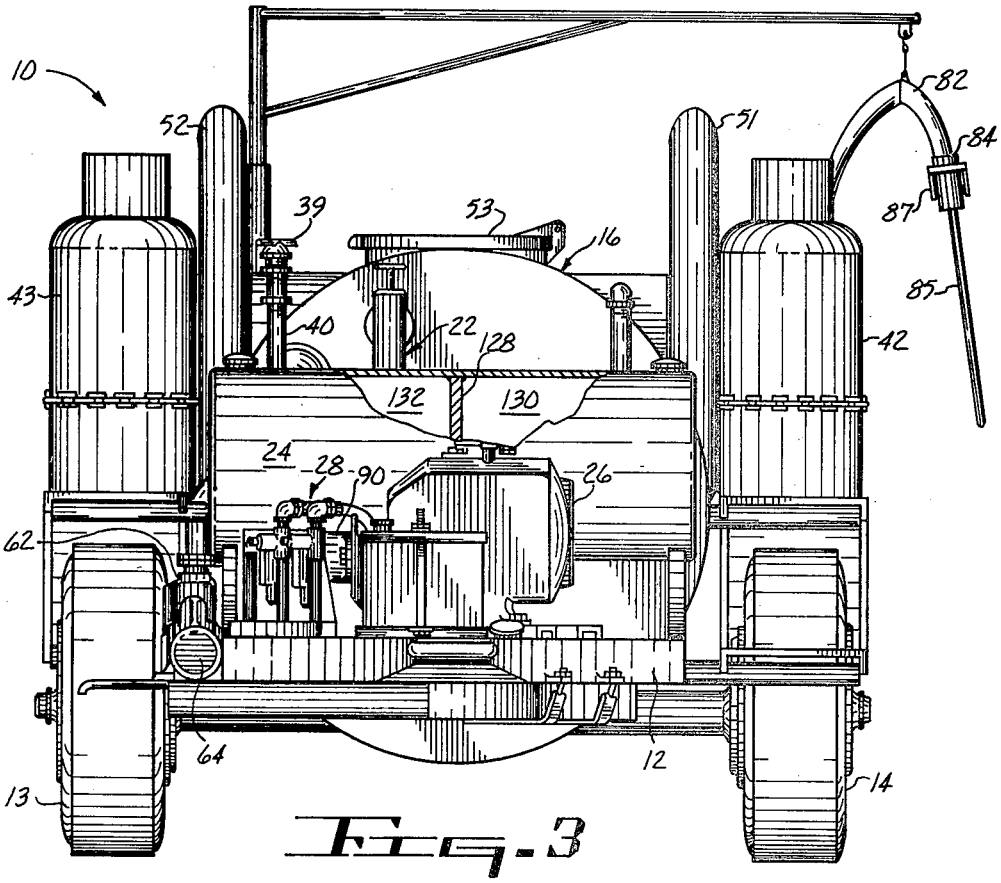
FIG. 3 is a front elevational view of the mechanism of the present invention.

Referring more particularly to the drawings, FIGS. 1, 2 and 3 illustrate the materials handling and application mechanism of the present invention which is indicated generally by the reference numeral 10. The mechanism 10 is preferrably in the form of a trailer vehicle and is therefore provided with the usual frame 11 having a suitable tongue 12 on the forward end and having the usual wheels 13 and 14.

As will hereinafter be described in detail, the main components and subsystems of the mechanism 10 include a materials tank 16 which is mounted on the frame 11 adjacent the rearwardly disposed end thereof, with a primary heating means 18, and a secondary or auxiliary heating means 20, which are both located at the back, or rearwardly disposed end of the materials tank. A materials mixing means 21 is provided within the materials tank 16 and a materials delivery plumbing system 22 is located principally at the forward or front end of the tank 16. A hydraulic oil/solvent tank 24 is mounted on the frame 11 immediately forward of the delivery plumbing system 22. A suitable engine 26 is mounted on the tongue 12 for driving a hydraulic system 28, the components of which are disposed at various locations on the trailer frame 11.

The various components and subsystems identified above all cooperate to provide the mechanism 10 with the capability of preparing, handling and applying various types of liquid compositions such as those commonly used in the construction arts. Although the mechanism 10 is capable of accommodating many types of compositions, its main design objective is to handle an asphalt-rubber composition, of the type used, for example, in roadway coating and repair work.

As is known, an asphalt-rubber composition is a solid at normal temperatures, and must be heated to approximately 300° F. to 450° F. to a molten state for application purposes. Accordingly, the materials tank 16, primary heating means 18, and secondary heating means 20 are especially designed to expeditiously accomplish the melting of the asphalt-rubber composition to achieve a molten state and to maintain that molten state.

Figure 4:
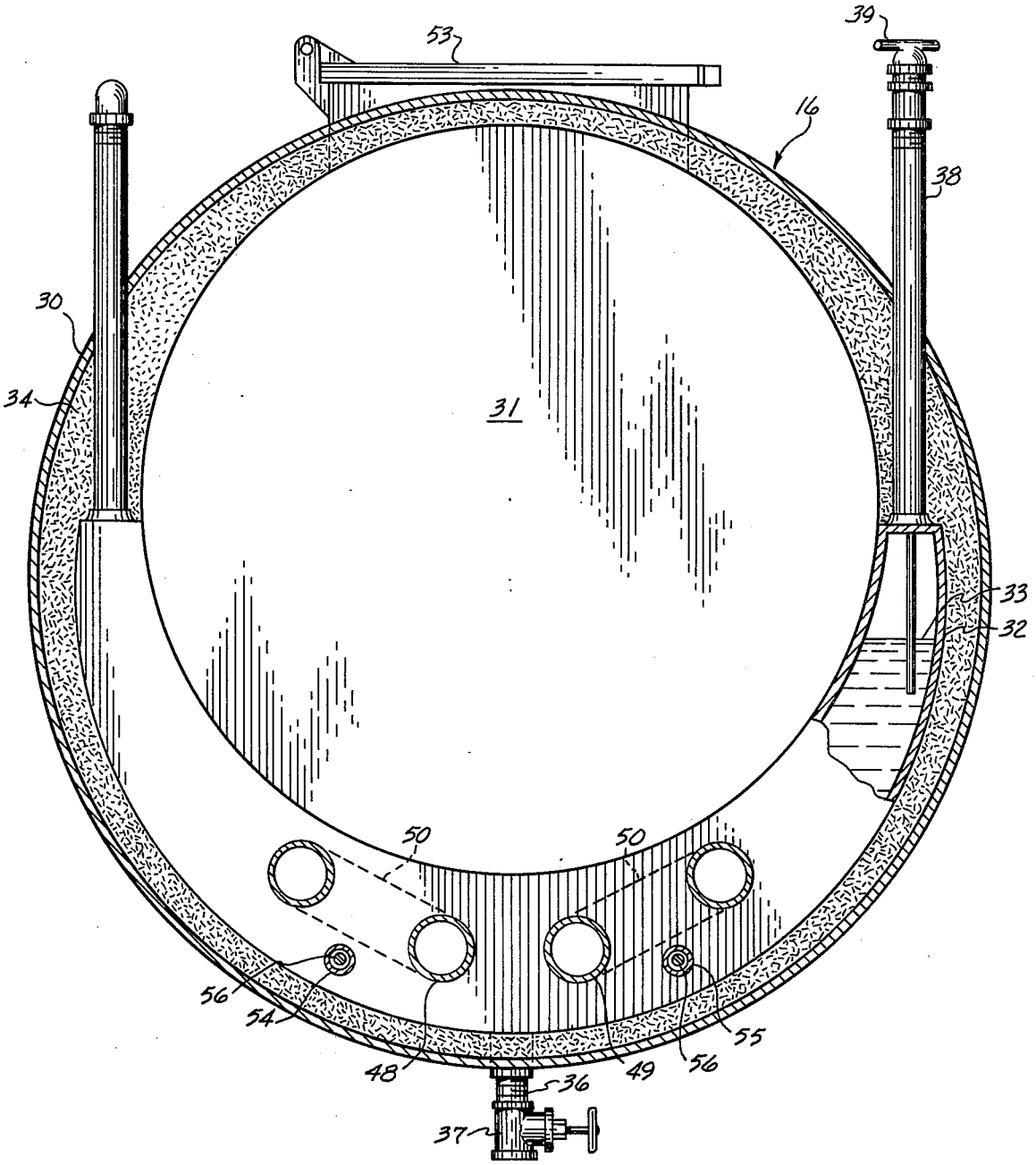
FIG. 4 is a fragmentary sectional view taken along the line 4—4 of FIG. 1.

As shown in FIGS. 1 and 4, the materials tank 16 is provided with a substantially cylindrical outer shell 30 having a cylindrical hot tank 31 eccentrically disposed therein. A heater jacket 32 having a heating oil 33 or other heatable liquid, therein is positioned below the hot tank 31 in coextensive contiguous engagement with approximately one-half of the curved peripheral surface thereof. The hot tank 31 and the heater jacket 32 have a suitable insulative blanket 34 wrapped therearound to retard heat loss. A suitable heating oil drain line 36 having an in-line shutoff valve 37 therein depend from the heating jacket 32 and extend exteriorly through the outer cylindrical shell 30. A fill line 38 extends upwardly from the heating jacket 32 with that line being capped by a dip stick 39 and having a vent line 40 (FIG. 1) connected thereto. The vent line 40 is open to ambient to allow expansion and contraction of the heating oil, and the drain and fill lines 36 and 38, respectively, are provided to allow periodic replacement and/or replenishment of the heating oil.

As seen best in FIGS. 2 and 4 the primary heating means 18 includes a pair of tanks 42 and 43 for containing flammable gas, such as propane, which supplies the gas, through suitable controls (not shown), contained within a control box 44, to a pair of burners 46 and 47. The burners 46 and 47 are located within a spaced pair of heater flues 48 and 49 which extend through the rear wall of the cylindrical shell 30 of the materials tank 16, and extend into the heater jacket 32 and are formed in a loop configuration as at 50 (FIG. 4), and extend rearwardly and upwardly therefrom to provide exhaust stacks 51 and 52.

It will be noted that the asphalt-rubber composition may be melted exteriorly of the mechanism 10 and supplied thereto in a molten state. However, in most situations, the asphalt-rubber composition is in the solid state in the form of blocks (not shown) which are deposited into the hot tank 31 through a suitable fill port 53 provided on the top of the materials tank 16.

It will now be apparent that the gas burners 46 and 47 are employed to heat the heating oil 33 with that heat being transferred to the hot tank 31 to melt and maintain the molten state of the asphalt-rubber composition.

The above described primary heater means 18 is employed to melt the asphalt-rubber composition and maintain the molten state thereof during normal operation of the mechanism 10. However, in many instances, the mechanism 10 will be placed in a standby status as a result of, for example, a paved surface not being ready for the application of the molten composition, during overnight periods and similar situations. If the mechanism 10 is not to be used for a prolonged period, the primary heater means 18 may be shut off which would allow the molten composition to solidify and when it is desired to resume operations, the solidified composition will need to be remelted. However, in instances where the standby period is of a relatively short duration, it is more economical to maintain the molten state of the material, and this is ideally accomplished by utilization of the secondary, or auxiliary heater means 20.

The auxiliary heater means 20 is ideally employed as an initial warming device. For example, when it is known that the apparatus 10 is to be used on a certain day, activation of the auxiliary heater means 20 the night before will substantially reduce the startup time on the day that the apparatus 10 is to be used.

As shown in FIGS. 2 and 4, the auxiliary heater means 20 includes a spaced pair of threaded receptacles 54 and 55 which are mounted in the rear wall of the materials tank 16. Each of the threaded receptacles 54 and 55 have an electrically operated heating element 56 mounted therein, with those elements being coupled by means of cables 57 and 58 to an outlet 59 mounted on the control box 44. Thus, when the mechanism 10 is to be placed on standby status or as a preliminary warming device, the heating elements 56 are simply plugged into an external source of electrical power (not shown) so that the molten state of the asphalt-rubber composition may be achieved and/or maintained by utilization of an energy form which is more readily available and more economical to use as compared to the flammable gas.

The desirable characteristics of an asphalt-rubber composition over asphalt alone are well known, however, mixing and more or less continuous agitation of molten asphalt-rubber must be accomplished to prevent floating of the finely ground rubber particles so as to achieve a homogeneous mixture. Therefore, the materials tank 16 is provided with the materials mixing means 21. The mixing means 21 may be in the form of any suitable device for agitating the materials, however, it is preferrably in the form of an auger mechanism such as that fully disclosed in U.S. Pat. No. 3,610,588 issued on Oct. 5, 1971. The auger mechanism includes, among other things, a shaft 60 which extends forwardly from the materials tank 16 and is rotatably driven by a hydraulic motor 61 coupled to the extending end thereof.

A materials pump 62 (FIG. 1) is suitably mounted on the trailer frame 11 to pump the molten asphalt-rubber composition out of the materials tank 16 through a materials supply pipeline 63 coupled to the outlet of the tank, and to deliver the molten material under pressure to the other components of the materials delivery plumbing system 22, as will hereinafter be described in detail. The materials pump 62 is driven by a hydraulic motor 64 which is coupled thereto by a shaft 65.

Figure 5:
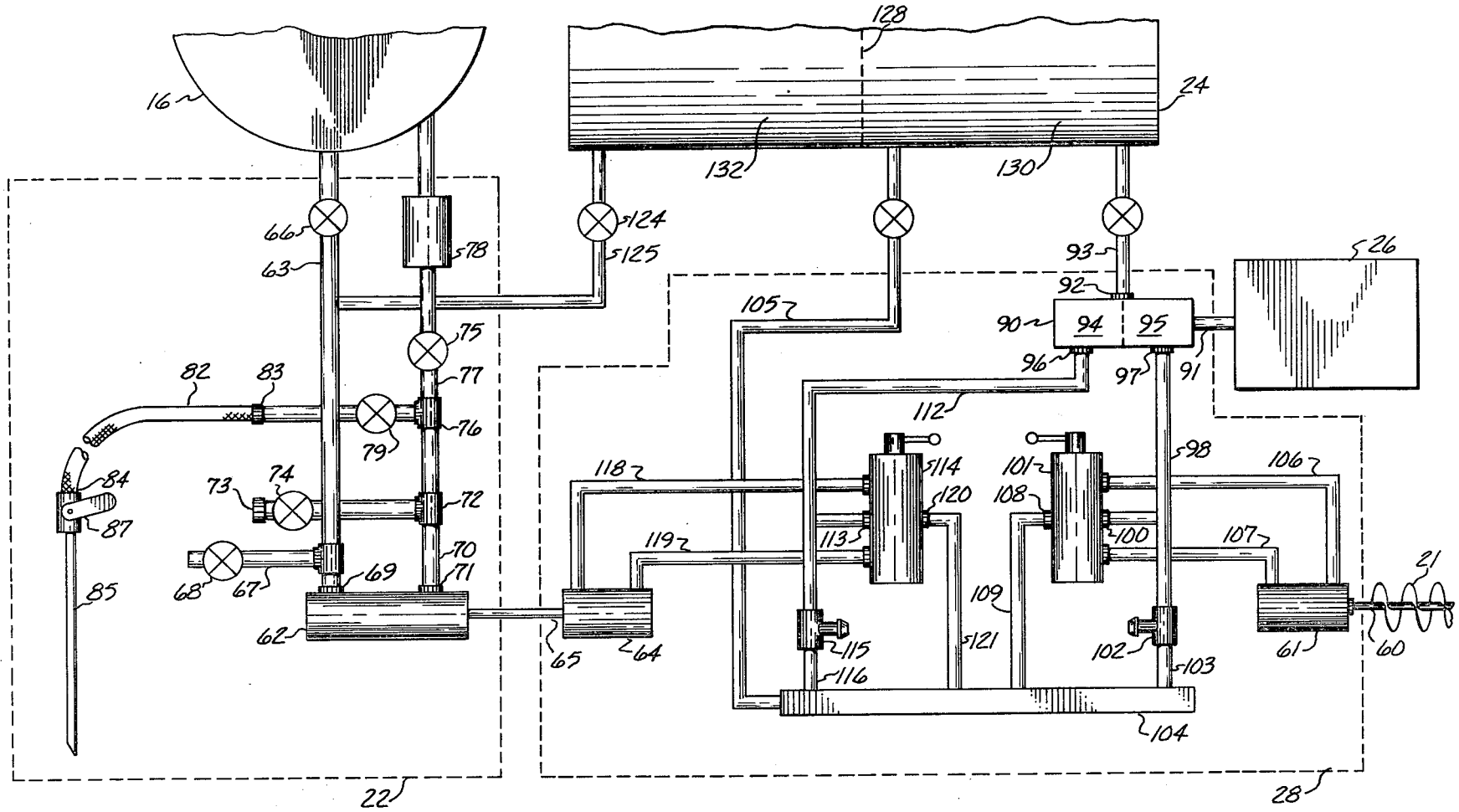
FIG. 5 is a diagrammatic illustration showing the hydraulic drive system, materials delivery system, and cleanout system of the mechanism of the present invention.

As seen in FIG. 5, the materials supply pipeline 63 of the materials delivery plumbing system 22 is provided with an in-line shutoff valve 66 therein, and has a branch line 67 connected thereto with the branch line having a shutoff valve 68 therein. The branch line 67 serves as an auxiliary fill port through which asphalt-rubber composition in molten form may be supplied to the materials tank 16 by utilization of the materials pump 62. The branch line 67 may also be employed to drain the molten asphalt-rubber composition from the materials tank 16 by means of gravity flow. The materials supply pipeline 63 is coupled to the inlet port 69 of the materials pump 62, and a materials delivery pipeline 70 is connected to the outlet port 71 thereof. The delivery pipeline 70 has a first tee 72 therein for coupling an auxiliary pipeline 73 thereto, with the auxiliary pipeline having a shutoff valve 74 therein, and serving as an alternate port to which a suitable materials applicator (not shown) may be coupled. A second tee 76 is provided in the materials delivery pipeline 70 for connecting a materials by-pass pipeline 77 thereto, with that by-pass pipeline 77 having a by-pass valve 78 mounted therein as will hereinafter be described. Downstream of the second tee 77, the materials delivery pipeline has a shutoff valve 79 therein, and the delivery pipeline 70 extends from that valve 79 through the materials tank 16 (FIG. 1) and exits therefrom at the rear of the tank within a warming compartment 80 (FIG. 2). The delivery pipeline 70 passes through the materials tank 16 so as to heat that portion of the delivery line and thus retard solidification of the molten asphalt-rubber composition therein. In addition to the above described rigid portion of the delivery pipeline 70, a flexible applicator hose 82 forms a part thereof and is connected to the outlet end 83 of the rigid portion of the materials delivery pipeline 70, with the hose 82 extending through the warming compartment 80 and having a free end 84 to which a suitable materials applicator 85 is coupled. The warming compartment 80 is provided with brackets therein for holding the applicator hose 82 which is stored therein when not being used. In this manner, the applicator hose 82 will be warmed to retard solidification of the molten asphalt-rubber composition. As shown, the applicator 85 is provided with a suitable shutoff valve 87 so that the operator may control the dispensing of molten material therefrom.

Referring once again to FIG. 5, the by-pass pipeline 77 having the in-line by-pass valve 78 therein, is connected between the materials delivery pipeline 70 and the materials tank 16. The by-pass valve 78 is a normally closed device which is adjustably set to automatically open when pressure in the by-pass line 77 goes above the predetermined pressure setting of the by-pass valve. Therefore, when the molten composition is being dispensed by the applicator 85, pressure within the by-pass line 77 will be below the pressure setting of the by-pass valve 78, and the molten composition will flow through the delivery pipeline 70, through the applicator hose 82 and will exit therefrom through the applicator 85. When the operator closes the applicator shutoff valve 87, pressure will increase in the delivery pipeline 70 and in the by-pass line 77 to a point where the by-pass valve 78 will open. In this manner, the molten composition will be circulated by the materials pump 62 rather than left standing in the upheated portions of the materials delivery pipeline 70, and the pump 62 will not be subjected to excessive back pressure.

Although the apparatus 10 can function quite well with the by-pass valve 78 operating as described above, the versitility of the apparatus 10 can be enhanced by employing a materials pump 62 which has an output capacity above that which is required in normal operation of the apparatus. Such an output capacity provides improved versitility by allowing simultaneous use of multiple applicators, the use of a spray applicator as opposed to a non-spray applicator, and the like. In such a situation, when the quantity of materials being delivered by the apparatus 10 is below the output capacity of the pump 62, the by-pass valve 78 is set at an appropriate point so that the excess materials being delivered by the pump 62 will be returned through the by-pass valve 78 to the materials tank 16.

As hereinbefore mentioned, the hydraulic system 28 is driven by the engine 26, which as seen in FIG. 5 is accomplished by a hydraulic pump 90 that is driven by the output shaft 91 of the engine. Hydraulic oil is supplied to the inlet port 92 of the hydraulic pump 90 by a line 93 which delivers oil from the hydraulic oil/solvent tank 24. The hydraulic pump 90 is a split pump in that its inlet port 92 simultaneously supplies oil to two segments 94 and 95 of the pump with each of those segments delivering a different output pressure to their respective outlet ports 96 and 97.

The outlet port 97 of the hydraulic pump 90 is coupled by means of a first hydraulic oil supply pipeline 98 to the inlet port 100 of a flow switching valve 101. That same oil supply pipeline 98 is also coupled to a flow control valve 102, the outlet of which is connected by means of a by-pass line 103 to a hydraulic oil collection manifold 104. The collection manifold 104 is provided with a return line 105 by which hydraulic oil within the manifold is returned to the tank 24. The flow control valve 102 is a manually adjustable valve which will allow more or less oil under pressure to be directed into the inlet port 100 of the flow switching valve 101. Therefore, the flow control valve 102 acts as a variable speed control for the hydraulic auger motor 61 as will become apparent as this description progresses.

The flow switching valve 101 is connected to the auger motor 61 by a pair of flow lines 106 and 107. In a first position of the flow switching valve 101, the flow line 106 is internally coupled to the inlet port 100 of the switching valve and the flow line 107 is internally coupled to the outlet port 108 of the switching valve which is connected by the line 109 to the collection manifold 104. In this first position of the flow switching valve 101, hydraulic oil under pressure will be supplied to the auger motor 61 by line 106 causing the motor to rotate in one direction and the oil will be returned by line 107 through the valve 101, line 109, manifold 104 and ultimately to the tank 24. The rotational direction of the auger motor 61 may be reversed by placing the switching valve 101 in a second position thereof which internally couples the flow line 107 to the inlet port 100 and internally couples the flow line 106 to the outlet port 108. Thus, hydraulic oil under pressure will flow in the reverse direction through the auger motor 61 and cause it to rotate in the direction opposite to that described above. The flow switching valve 101 is provided with another position which internally couples the hydraulic oil supply line 98 to the line 109 so that the oil will circulate without driving the auger motor 61. This other position is employed during engine start-up periods and the like.

Therefore, the flow control valve 102 provides means for varying the speed of the auger motor 61, and the flow switching valve 101 allows reversible driving thereof. The advantage of those two features may be easily seen upon consideration of the melting operation which takes place in the materials tank 16. That melting operation can be expedited considerably by operation of the auger 21, with low speed operation being desirable at the beginning of the melting operation, and reversed driving being advantageous when the auger becomes jammed by engaging solid blocks of the yet unmelted asphalt-rubber composition.

The outlet port 96 of the hydraulic pump 90 is coupled by means of a second hydraulic oil supply pipeline 112 to the inlet port 113 of a second flow switching valve 114. That same hydraulic oil supply pipeline 112 is also coupled to a flow control valve 115 which has its outlet connected by a by-pass line 116 to the hydraulic oil collection manifold 104. The flow control valve 115 is a manually adjustable device which will allow more or less oil to be supplied to the inlet port 113 of the flow switching valve 114. In this manner, the flow control valve 115 acts as a variable speed control for the hydraulically operated materials pump drive motor 64, as will hereinafter be described.

The flow switching valve 114 is connected to the pump drive motor 64 by a pair of flow lines 118 and 119. In a first position of the flow switching valve 114, the flow line 118 is internally connected to the inlet port 113 of the flow switching valve 114, and the flow line 119 is internally connected to the outlet port 120 of the switching valve, with the outlet port 120 being coupled by line 121 to the collection manifold 104. In this first position of the flow switching valve 114, hydraulic oil under pressure will be supplied to the pump drive motor 64 by flow line 118 causing it to rotate in one direction, and the oil will be returned by flow line 119 through the valve 114, line 121 to the manifold 104 and directed from the manifold through the return line 105 to the hydraulic oil/solvent tank 24. The rotational direction of the pump drive motor 64 may be reversed by placing the flow switching valve 114 in a second position thereof which internally couples the flow line 119 to the inlet port 113 of the switching valve, and internally couples the flow line 118 to the outlet port 120 thereof. Thus, hydraulic oil under pressure will flow in the direction reversed to that described above and will pass through the materials pump drive motor 64 causing it to rotate in the direction opposite to that described above.

The flow switching valve 114 is provided with another position, similar to that previously described with reference to the flow switching valve 101, so that hydraulic oil may be circulated without driving the pump motor 64.

It will now be seen that the flow control valve 115 provides means for varying the speed of the pump drive motor 64, and the flow switching valve 114 allows reversible driving thereof. Variable speed operation of the pump drive motor 64 allows the delivery rate of the molten asphalt-rubber compound to be varied, and the reversible driving of the pump drive motor 64 is a feature that is useful during purging of the materials delivery plumbing system 22 with solvent as will hereinafter be described in detail.

As hereinbefore mentioned, the materials delivery plumbing system 22 must be purged of the molten asphalt-rubber composition after utilization of the apparatus 10. This purging, or flushing, is accomplished by first closing the shutoff valve 66 in the materials supply pipeline 63 leading from the materials tank 16, and closing the shutoff valve 75 in the by-pass line 77. From this point on, two types or methods of purging may be employed. In most instances, conventional, or one way flow of solvent will suffice, and this is accomplished by opening the shutoff valve 124 in the solvent line 125, which is connected between the hydraulic oil/solvent tank 24 and the materials supply pipeline 63, and opening the valve 87 on the applicator 85. In this manner, solvent will be moved through the various lines and valves of the plumbing system 22 by means of the materials pump 62. In instances where the plumbing system 22 is particularly dirty or in the case of certain material compounds, a relatively small amount of solvent is allowed to enter the plumbing system 22 with the valve 87 of the applicator 85 kept closed, and the valve 124 is returned to the closed position after solvent is in the system. Then the solvent is reversibly moved to cause a swishing movement of the solvent in the system. when the swishing movement is completed, the valve 87 of the applicator 85 is opened to allow the solvent to be pumped out of the system 22.

In either case, i.e., conventional one-way purging, or swishing movement, the solvent is intentionally kept out of the by-pass valve 78 to prevent excess quantities of solvent from entering the materials tank 16. When the purging is completed, just prior to pumping of the solvent out of the system, the shutoff valve 75 is opened momentarily which allows a relatively small amount of solvent to pass through the by-pass valve 78.

As seen in FIG. 3, the hydraulic oil/solvent tank 24 is divided by a partition 128 to provide a hydraulic oil compartment 130 and a solvent compartment 132. This special configuration of the tank 24 is employed for efficient space utilization on the frame 11 of the mechanism 10, and allows both the solvent and hydraulic oil to be located in close proximity to the systems in which they are used. Further, the solvent will aid in cooling of the hydraulic oil.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What we claim is:

1. A mechanism for preparing, handling and application of liquid materials comprising:

(a) a materials tank having a fill port for receiving materials and having an outlet;

(b) primary heater means in communication with said materials tank for melting and maintaining the molten state of the materials receivable in said materials tank;

(c) mixing means in said materials tank for mixing the materials receivable in said materials tank;

(d) a materials delivery plumbing system including,

I. a materials delivery pump having an inlet and an outlet,

II. a materials supply pipeline having one end connected to the outlet of said materials tank and the other end connected to the inlet of said materials delivery pump, III. a materials delivery line having one end coupled to the outlet of said materials delivery pump, and IV. an applicator means coupled to the opposite end of said delivery line; and (e) said materials delivery line including, I. a rigid portion extending from the outlet of said materials delivery pump through said materials tank so that said rigid portion is heated by said primary heater means, and II. a flexible portion connected to said rigid portion and having said applicator means connected thereto.

2. A mechanism as claimed in claim 1 and further including a hydraulic system which comprises:

(a) a first drive motor coupled to said mixing means for driving thereof;

(b) a second drive motor coupled to said materials pump of said materials delivery plumbing system for driving thereof;

(c) a hydraulic oil tank having an outlet;

(d) an engine driven hydraulic oil pump having an inlet coupled to the outlet of said hydraulic oil tank and having a first outlet and a second outlet;

(e) a first hydraulic oil supply pipeline coupled to the first outlet of said oil pump;

(f) a first flow switching valve having an inlet connected to said first hydraulic oil supply pipeline, said first flow switching valve coupled to said first drive motor and having a first position which drives said first drive motor in one direction and a second position which drives said first drive motor in the opposite direction;

(g) a second hydraulic oil supply pipeline coupled to the second outlet of said oil pump; and (h) a second flow switching valve having an inlet connected to said second hydraulic oil supply pipeline, said second flow switching valve coupled to said second drive motor and having a first position which drives said second drive motor in one direction and a second position which drives said second drive motor in the opposite direction.

3. A mechanism as claimed in claim 2 and further comprising a flow control valve in said first hydraulic oil supply pipeline, said flow control valve being adjustable to vary the flow rate of hydraulic oil to said first flow switching valve to vary the rate of speed of said first drive motor.

4. A mechanism as claimed in claim 2 and further comprising a flow control valve in said second hydraulic oil supply pipeline, said flow control valve being adjustable to vary the flow rate of hydraulic oil to said second flow switching valve to vary the rate of speed of said second drive motor.

5. A mechanism as claimed in claim 1 and further including a hydraulic system which comprises:

(a) a first drive motor coupled to said mixing means for driving thereof;

(b) a second drive motor coupled to said materials pump of said materials delivery plumbing system for driving thereof;

(c) a hydraulic oil tank having an outlet and a return port;

(d) an engine driven hydraulic oil pump having an inlet coupled to the outlet of said hydraulic oil tank and having a first and a second outlet;

(e) a first hydraulic oil supply pipeline having one end coupled to the first outlet of said oil pump;

(f) a second hydraulic oil supply pipeline having one end coupled to the second outlet of said oil pump;

(g) a hydraulic oil collection manifold having the other end of said first hydraulic oil supply pipeline connected thereto and having the other end of said second hydraulic oil supply pipeline connected thereto, said collection manifold connected to the return port of said hydraulic oil tank;

(h) a first flow control valve in said first hydraulic oil supply pipeline for adjustably controlling the flow rate therethrough;

(i) a second flow control valve in said second hydraulic oil supply pipeline for adjustably controlling the flow rate therethrough;

(j) a first flow switching valve having an inlet connected to said first hydraulic oil supply pipeline intermediate its connection with the first outlet of said oil pump and said first flow control valve, said first flow switching valve coupled to said first drive motor and having a first position which drives said first motor in one direction and a second position which drives said first motor in the opposite direction, said first flow switching valve having a return port coupled to said collection manifold; and (k) a second flow switching valve having an inlet connected to said second hydraulic oil supply pipeline intermediate its connection with the second outlet of said oil pump and said second flow control valve, said second flow switching valve coupled to said second drive motor and having a first position which drives said second motor in one direction and a second position which drives said second motor in the opposite direction, said second flow switching valve having a return port coupled to said collection manifold.

6. A mechanism as claimed in claim 1 wherein said materials delivery plumbing system further comprises:

(a) a materials by-pass line having one end connected to said materials delivery line intermediate the ends thereof and having its other end connected to said materials tank; and (b) a by-pass valve in said materials by-pass line, said by-pass valve being a normally closed pressure responsive valve which is set to open at a predetermined pressure so that materials in said materials delivery line will be returned to said materials tank when said by-pass valve is open.

7. A mechanism as claimed in claim 1 and further comprising:

(a) valve means in said materials supply pipeline adjacent the outlet of said materials tank for shutting off the flow of materials therefrom into said materials delivery plumbing system;

(b) a solvent tank having an outlet;

(c) a solvent delivery line having one end connected to the outlet of said solvent tank and having its other end connected to said materials supply pipeline between said valve means and the end thereof which is connected to the inlet of said materials delivery pump; and (d) a shutoff valve in said solvent delivery line intermediate the ends thereof for optionally delivering solvent to said materials delivery plumbing system for purging thereof.

8. A mechanism as claimed in claim 1 and further comprising a warming compartment on said materials tank through which said flexible portion of said materials delivery line passes, said warming compartment having means therein for storing said flexible portion.

9. A mechanism as claimed in claim 1 wherein said materials tank comprises:

(a) an outer shell;

(b) a hot tank within said outer shell for containing the materials receivable through said fill port; and (c) a heater jacket for containing a heatable liquid, said heater jacket positioned within said outer shell and in coextending contiguous engagement with at least a portion of the periphery of said hot tank, said heater jacket having said primary heater means extending thereinto.

10. A mechanism as claimed in claim 1 wherein said materials tank comprises:

(a) an outer shell of substantially cylindrical configuration;

(b) a hot tank of substantially cylindrical configuration eccentrically disposed within said outer shell, said hot tank having the fill port and outlet of said materials tank communicating therewith;

(c) a heater jacket for containing a heatable liquid, said heater jacket positioned within said outer shell below said hot tank and in coextending contiguous engagement with approximately one-half of the curved peripheral surface of said hot tank, said heater jacket having said primary heater means extending thereinto; and (d) an insulative blanket within said outer shell and disposed to circumscribe the exposed surfaces of said hot tank and said heater jacket.

11. A mechanism as claimed in claim 1 and further comprising a secondary heater means in communication with said materials tank and operable to maintain the molten state of the materials receivable in said materials tank, said secondary heater means operable on an energy form which is different from the energy form upon which said primary heater means is operable.

12. A mechanism as claimed in claim 11 wherein said secondary heater means comprises:

(a) at least one receptical mounted on said materials tank; and (b) an electrically operable heating element connected to said receptical.

13. A mechanism as claimed in claim 1 wherein said primary heater means comprises:

(a) at least one tank for containing a flammable gas;

(b) at least one heater flue in said materials tank and extending therefrom;

(c) a burner in said heater flue; and (d) means connecting said tank with said burner for delivering gas from said tank to said burner for operation thereof.

14. A mechanism as claimed in claim 2 and further comprising:

(a) said hydraulic oil tank having a first compartment formed therein for containing hydraulic oil for use in said hydraulic system and having a second compartment formed therein for containing solvent, said second compartment having an outlet;

(b) valve means in said materials supply pipeline adjacent the outlet of said materials tank for shutting off the flow of materials therefrom into said materials delivery plumbing system;

(c) a solvent delivery line having one end connected to the outlet of said second compartment and having its other end connected to said materials supply pipeline between said valve means and the end thereof which is connected to the inlet of said materials delivery pump; and (d) a shutoff valve in said solvent delivery line intermediate the ends thereof for optionally delivering solvent to said materials delivery plumbing system for purging thereof.

15. A mechanism for preparing, handling and application of liquid materials comprising:

(a) a materials tank having a fill port for receiving materials and having an outlet;

(b) primary heater means in communication with said materials tank for melting and maintaining the molten state of the materials receivable in said materials tank;

(c) mixing means in said materials tank for mixing the materials receivable in said materials tank;

(d) a materials delivery plumbing system including,

I. a materials delivery pump having an inlet and an outlet,

II. a materials supply pipeline having one end connected to the outlet of said materials tank and the other end connected to the inlet of said materials delivery pump, III. a materials delivery line having one end coupled to the outlet of said materials delivery pump, and P2 IV. an applicator means coupled to the opposite end of said delivery line; and (e) a hydraulic system including, I. a first drive motor coupled to said mixing means for driving thereof, II. a second drive motor coupled to the materials pump of said materials delivery plumbing system for driving thereof, III. a hydraulic oil tank having an outlet, IV. an engine driven hydraulic oil pump having an inlet coupled to the outlet of said hydraulic oil tank and having first and second outlets, V. a first hydraulic oil supply pipeline coupled to the first outlet of said oil pump, VI. a first flow switching valve having an inlet connected to said first hydraulic oil supply pipeline, said first flow switching valve coupled to said first drive motor and having a first position which drives said first drive motor in one direction and a second position which drives said first drive motor in the opposite direction, VII. a second hydraulic oil supply pipeline coupled to the second outlet of said oil pump, and VIII. a second flow switching valve having an inlet connected to said second hydraulic oil supply pipeline, said second flow switching valve coupled to said second drive motor and having a first position which drives said second drive motor in one direction and a second position which drives said second drive motor in the opposite direction.

16. A mechanism as claimed in claim 15 and further comprising a flow control valve in said first hydraulic oil supply pipeline, said flow control valve being adjustable to vary the flow rate of hydraulic oil to said first flow switching valve to vary the rate of speed of said first drive motor.

17. A mechanism as claimed in claim 15 and further comprising a flow control valve in said second hydraulic oil supply pipeline, said flow control valve being adjustable to vary the flow rate of hydraulic oil to said second flow switching valve to vary the rate of speed of said second drive motor.

18. A mechanism for preparing, handling and application of liquid materials comprising:

(a) a materials tank having a fill port for receiving materials and having an outlet;

(b) primary heater means in communication with said materials tank for melting and maintaining the molten state of the materials receivable in said materials tank;

(c) mixing means in said materials tank for mixing the materials receivable in said materials tank;

(d) a materials delivery plumbing system including,

I. a materials delivery pump having an inlet and an outlet,

II. a materials supply pipeline having one end connected to the outlet of said materials tank and the other end connected to the inlet of said materials delivery pump, III. a materials delivery line having one end coupled to the outlet of said materials delivery pump, and IV. an applicator means coupled to the opposite end of said delivery line; and (e) said materials tank including, I. an outer shell of substantially cylindrical configuration, II. a hot tank of substantially cylindrical configuration eccentrically disposed within said outer shell, said hot tank having the fill port and the outlet of said materials tank communicating therewith, III. a heater jacket for containing a heatable liquid, said heater jacket positioned within said outer shell below said hot tank and in coextending contiguous engagement with approximately one-half of the curved peripheral surface of said hot tank, said heater jacket having said primary heater means extending thereinto, and IV. an insulative blanket within said outer shell and disposed to circumscribe the exposed surfaces of said hot tank and said heater jacket.

* * * * *